United States Patent [19]

Rivere

[11] 3,949,713

[45] Apr. 13, 1976

[54] ELECTRONIC FUEL INJECTION SYSTEM FOR INTERNAL COMBUSTION ENGINES

[75] Inventor: Jean Pierre Rivere, Paris, France

[73] Assignees: Regie Nationale des Usines Renault; Automobiles Peugeot, both of Paris, France

[22] Filed: Jan. 21, 1974

[21] Appl. No.: 435,211

[30] Foreign Application Priority Data

Jan. 19, 1973 France ..... 73.01898

[52] U.S. Cl.... 123/32 EA; 123/32 AE; 123/140 FG

[51] Int. Cl.[2] ..... F02B 3/00

[58] Field of Search.... 123/32 AE, 32 EA, 139 AA, 123/139 BF, 139 R, 140

[56] References Cited

UNITED STATES PATENTS

| | | | |
|---|---|---|---|
| 2,747,555 | 5/1956 | Brunner | 123/139 R |
| 2,941,524 | 6/1960 | Aldinger et al. | 123/32 EA |
| 3,191,812 | 6/1965 | Asaka et al. | 123/139 R |
| 3,288,379 | 11/1966 | Croft et al. | 123/32 R |
| 3,319,613 | 5/1967 | Begley et al. | 123/32 EA |
| 3,557,765 | 1/1971 | Nystrom | 123/140 FG |
| 3,598,097 | 8/1971 | Eheim et al. | 123/140 FG |
| 3,682,145 | 8/1972 | Ohtani | 123/32 EA |
| 3,695,235 | 10/1972 | Anderson | 123/32 R |
| 3,718,127 | 2/1973 | Gates et al. | 123/140 FG |
| 3,796,205 | 3/1974 | Links et al. | 123/32 AE |

FOREIGN PATENTS OR APPLICATIONS

| | | | |
|---|---|---|---|
| 1,140,292 | 1/1969 | United Kingdom | |
| 1,502,867 | 10/1967 | France | |
| 364,139 | 8/1962 | Switzerland | |
| 2,101,950 | 3/1972 | France | |
| 1,301,626 | 8/1969 | Germany | 123/32 EA |
| 851,576 | 8/1970 | Canada | 123/32 EA |

*Primary Examiner*—Wendell E. Burns
*Assistant Examiner*—Paul Devinsky

[57] ABSTRACT

An electronic fuel injection system for an internal combustion engine wherein the amount of fuel injected is metered according to variations in the injection pressure. Mechanical injectors having a preset opening pressure are fed from a distribution chamber which, in turn, is fed by a fuel circuit pressurized by by an electronically controlled fuel supply flow. The fuel supply flow is the difference between the flow through an inlet injector receiving fuel under pressure and that through an outlet injector regulating the return flow of fuel to the reservoir, these injectors being of the continuous flow electromagnetic type. The fuel supply is frequency controlled by a computer and regulated by a servo loop to assure a constant richness. The preferred embodiment is particularly adaptable to a low priced electronic fuel injection system using mechanical devices whose precision is relatively unimportant.

14 Claims, 5 Drawing Figures

ELECTRONIC FUEL INJECTION SYSTEM FOR INTERNAL COMBUSTION ENGINES

BACKGROUND OF THE INVENTION

1. Field of the Invention:

The present invention is related to a fuel injection system for internal combustion engines, and more particularly to a type utilizing electronic control of the amounts of fuel injected according to the injection pressure.

2. Description of the Prior Art:

Known means of electronic fuel injection systems adjust the quantity of fuel injected as a function of the instantaneous operating conditions. This control is effected by regulating the output of the injection pump or by varying the length of time the injectors remain open while supplied from a constant pressure pump, or by varying the injection output by adjusting the injector output orifice areas. All of such known methods have the disadvantage of requiring a costly regulator system to achieve acceptable performance. For this intensely practical reason, such systems have not been able to make any headway in replacing the conventional carburetor in automotive technology.

SUMMARY OF THE INVENTION

Accordingly, a primary object of the present invention is to provide a fuel injection technique which is competitive with existing systems. The present invention comprises a fuel supply system having injectors fed by a distribution chamber from a pressurized fuel system and an electronic regulator for the output of the supply, wherein the output is the difference between that of an inlet injector receiving the pressurized fuel and that of an outlet injector regulating the return flow of fuel to the reservoir.

More precisely, the control of the output is provided by an inlet injector having a controllable flow, the output of which goes both to the cylinders through unregulated injectors with preset opening pressures of a known type and to a return circuit through an outlet injector having a flow control of the same type as the inlet injector. The control of the output is effected in a differential manner between the controllable supply inlet injector and the controllable return outlet injector.

Another object of the present invention is to provide precision control of the differential supply by using a servo loop to compensate for the variation in output due to inaccuracies in the injectors which regulate the supply and return on the basis of a measurement of the difference between the output pressure of the inlet injector and the input pressure of the outlet injector.

A further object of the present invention is to provide a novel and unique electronic circuit embodying said servo loop.

An additional object of the present invention is to regulate the opening of the inlet and outlet injectors by a controlled frequency current and to utilize such injectors with a continuous flow that is proportional only to the frequency of the control signal.

Such a system, in which the sum of the flow of fuel injected into the cylinders equals the difference between the continuous flows of the inlet and outlet injectors, permits control over a very wide dynamic range, greater than a ratio of 1 to 100 between minimum and maximum outputs. This is accomplished with very simple injectors which do not require great precision and therefore can be produced inexpensively. Also, the precision in metering is independent of the supply pressure. If the continuous flow of the inlet and outlet injectors is proportional to the frequency of the control signal, it may be made independent of the shape of the signal.

The only precision required in the system is that the cross-sections of the input orifice of the outlet injector and the output orifice of the inlet injector have identical areas, utilized for the measurement of the pressure difference for the control loop, a condition which can be easily realized by drilling the orifices simultaneously.

A still further object of the present invention is to provide an injector at the cylinder having an improved pressure dynamic response to provide greater precision in the flow of injected fuel as a function of pressure variations in the injection supply line.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 1:
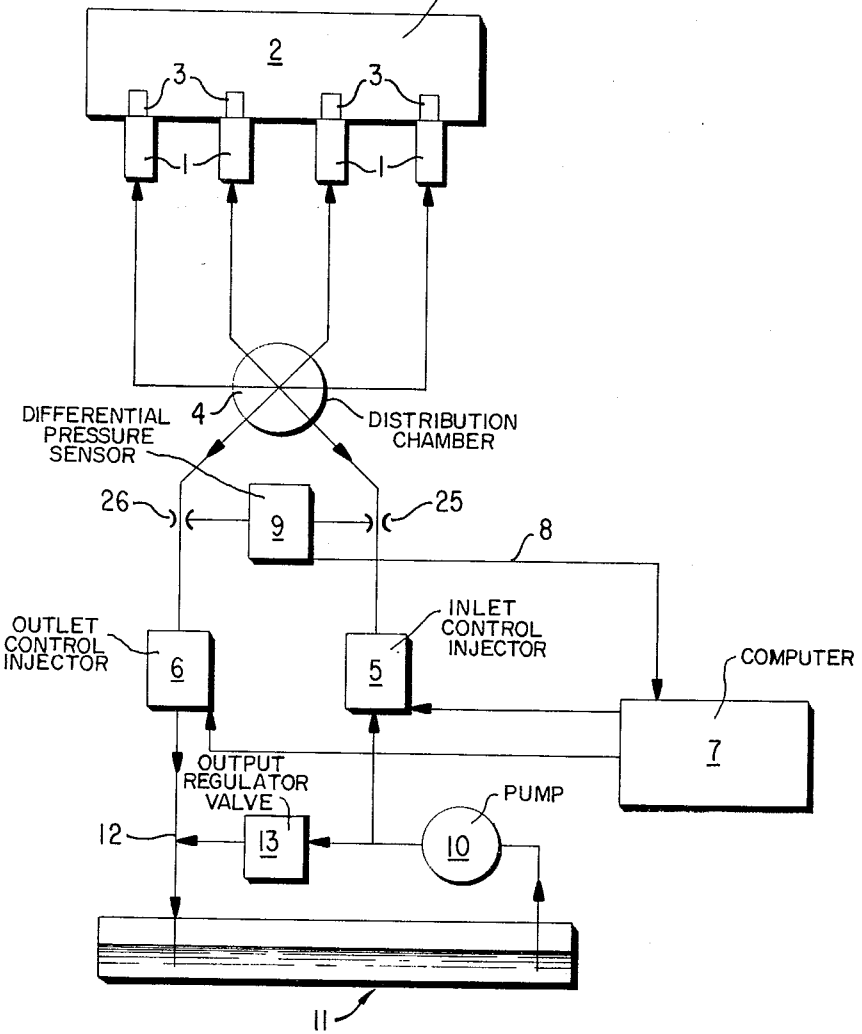
FIG. 1 is a schematic diagram of a supply circuit according to a preferred embodiment of the present invention.

Referring now to the drawings, wherein like reference numerals designate idnetical or corresponding parts throughout the several views, and more particularly to FIG. 1 thereof, which depicts a schematic of the fuel supply system according to the present invention wherein the injectors 1 are connected in a well-known manner at each inlet orifice to the cylinders of an internal combustion engine 2.

These injectors, an improved version of which will be described hereinafter according to another aspect of the present invention, are of a current mechanical type which allow fuel to pass which has a pressure greater than their preset opening pressure. Injectors 1 advantageously contain at one end an isobaric chamber 3 for pressure stabilization of a type described more fully in French Pat. application No. 72/44,846 of Dec. 15, 1972 in the same name as the assignee of the present application now U.S. Pat. No. 2,211,049 (corresponding to U.S. Pat. No. 3,856,312. Injectors 1 are fed successively by a distribution chamber 4 which is connected in series in the supply circuit between the inlet control injector 5 and the outlet control injector 6. The distribution chamber 4 may, for example, be a rotary selective valve of the type disclosed in FIG. 2 of U.S. Pat. No. 2,747,555 to Brunner. The output openings of injectors 5 and 6 having electromagnetic actuation are controlled by an electronic computer 7, itself regulated by a servo feedback loop 8 and a conventional differential pressure sensor 9 of the type marketed by Bell & Howell, Schlumberger, National Semi-Conductors, and other manufacturers. Devices of this type are disclosed in French Pat. No. 1,501,044 to Siemens and Halske. Such devices may comprise, e.g. a membrane and semiconductor strain gauge, which compensates for the imprecision in the functioning of the injectors 5 and 6.

The pressurized fuel is furnished to the inlet injector 5 by a supply pump 10 connected to a reservoir 11 and possessing a direct return 12 to the reservoir 11 through an output regulator valve 13 to assure an essentially constent supply pressure.

Figure 2:
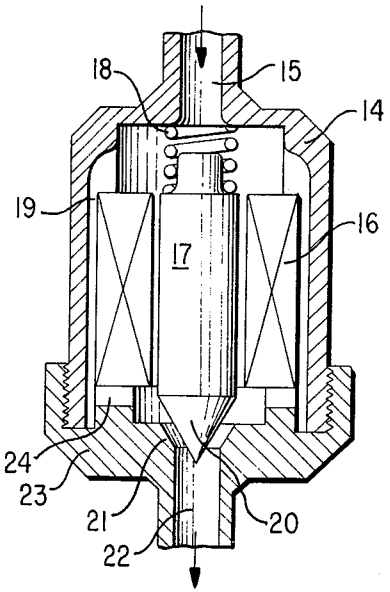
FIG. 2 is a cross-sectional view of an inlet or an outlet injector having differential control according to the invention.

The injectors 5 and 6 preferably comprise identical electromagnetic types an example of a preferred embodiment of which is illustrated in FIG. 2. However, they may also comprise ball-type injectors, such as those which are taught in the French Pat. application 72/00327 of Jan. 6, 1972 in the same name as the assignee of the present application, now U.S. Pat. No. 2,166,734 (also corresponding to U.S. Pat. No. 3,685,312). The latter injectors allow for control of the fuel output independently of the instantaneous pressure in the intake line up-stream.

Referring now to FIG. 2, the injector comprises a housing 14 to which upstream tubing 15 is connected and within which is contained a solenoid coil 16. A valve stem 17 slidable within the coil 16 is in contact with a spring 18 at the rear of the housing 14. Longitudinal channels 19 are provided in the housing 14 to permit the passage of the fuel along the coil 16 and to provide cooling of the latter. The conical end 20 of stem 17 fits against a seat 21, serving as the port to an outlet tubing 22, positioned in the center of a sealing cover 23 which screws onto the housing 14 and holds down the coil 16. Radial channels 24 provide communication between the channels 19 and the seat 21.

The injector described hereinabove is preferably driven by an alternating current or by a pulsed current with variable frequency such that, over a given frequency range, the lifting of stem 17 will be proportional to the frequency. The result is a continuous flow of fuel proportional to the frequency of the current driving the coil 16. A ratio of 1 to 10 in output is easily obtained with less than 1 percent nonlinearity in the output frequency curve.

Figure 3:
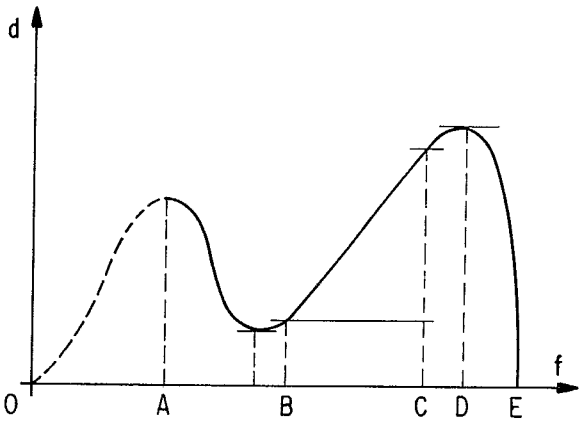
FIG. 3 is a graph depicting the lift of the injector of FIG. 2 as a function of frequency.

FIG. 3 shows such a curve of the output d as a function of the frequency *f*. The output d corresponds to the lifting of the stem 17. Portion OA of the curve corresponds to the range in which the injector operates in a synchronous mode and in which the lift follows the frequency up to the resonant frequency at A. After a progressive decrease and passage through a minimum, the lift increases in a linear fashion between the frequency limits B and C, thereafter reaching at D the cut-off frequency beyond which the lift decreases rapidly to zero at E where the stem no longer responds at all to frequency variations.

The dynamic range of the output of such an injector, i.e. the ratio between its minimum and maximum outputs, is on the order of 10 to 1 at most as pointed out above. The combination and differential control of injectors 5 and 6 permits easy attainment of a dynamic range in the output on the order to 1 to 50 in continuous injection. The sum of the output flows through the injectors equals the difference between the flows into injector 5 and out of injector 6. By this combination, it is possible to obtain a dynamic range in output equal to or greater than 100 with injectors of limited performance.

The pressure upstream of injector 5 must exceed that downstream, which is the injection pressure at the engine, except for losses which are greater than the pressure in the return line to the reservoir downstream of injector 6. The use of inexpensive and relatively low precision injectors 5 and 6 is compensated by a servo feedback loop 8 from the differential pressure sensor 9 which is connected between the output orifice 25 of injector 5 and the input orifice 26 of injector 6, said orifices being identical. Thus, although not substantially improved by the differential connection which increases the sensitivity, the lack of precision and linearity of the injectors will be rectified by the servo loop which assures, by correcting their frequency of operation, a constant difference in their characteristics.

Accordingly, the precision of the injection output is independent of that of injectors 5 and 6 which, not having to be precision made, can be inexpensive, as well as the supply pressure from the pump 10 which can be equally economical. The system does not depend on the pressure but only on the flow rates.

The regulation of the pressure of the direct return line 12 to the tank 11 can be provided by a standard relief valve in 13. The injectors 1 can for example, have a nominal diameter of 1.6 mm for an output of 120 l./hr. It is not necessary for the nominal diameter of injectors 1 to be precise and identical, since the variations are absorbed by the identity of construction of sections 25 and 26 at the points of measurement of the differential pressure sensor 9 in the correction loop 8. This indentity can be ensured, for example, by simultaneous drilling of the orifices 25 and 26. This condition of identity permits a simplification of Bernouilli's formula as applied to the flow of the fuel supply which simplifies, according to the present invention, the necessary servo loop. This formula is normally written:

$$\frac{2\Delta p}{m} = V_1^2 - V_2^2$$

wherein $\Delta p$ represents the instantaneous pressure variation in the line, m is the volumetric mass of fuel; and $V_1$ and $V_2$ are the flow rates at the measuring points 25 and 26, respectively, having corresponding passage cross-sections $S_1$ and $S_2$.

If Q is the net flow at injectors 1, we have:

$$Q = S_1V_1 - S_2V_2$$

from which is deduced:

$$V_2 = \frac{S_1}{S_2}V_1 - \frac{Q}{S_2}.$$

Using this value of $V_2$ in Bernouilli's formula cited above with $S_2 = S_1$, the following simplified formula is obtained:

$$2\frac{\Delta p}{m} = \frac{Q}{S}(V_1 + V_2),$$

wherein $V_1 + V_2 = V =$ constant, or:

$$2\frac{\Delta p}{m} = \frac{Q}{S}V,$$

wherein $S = S_1 = S_2$.

Figure 4:
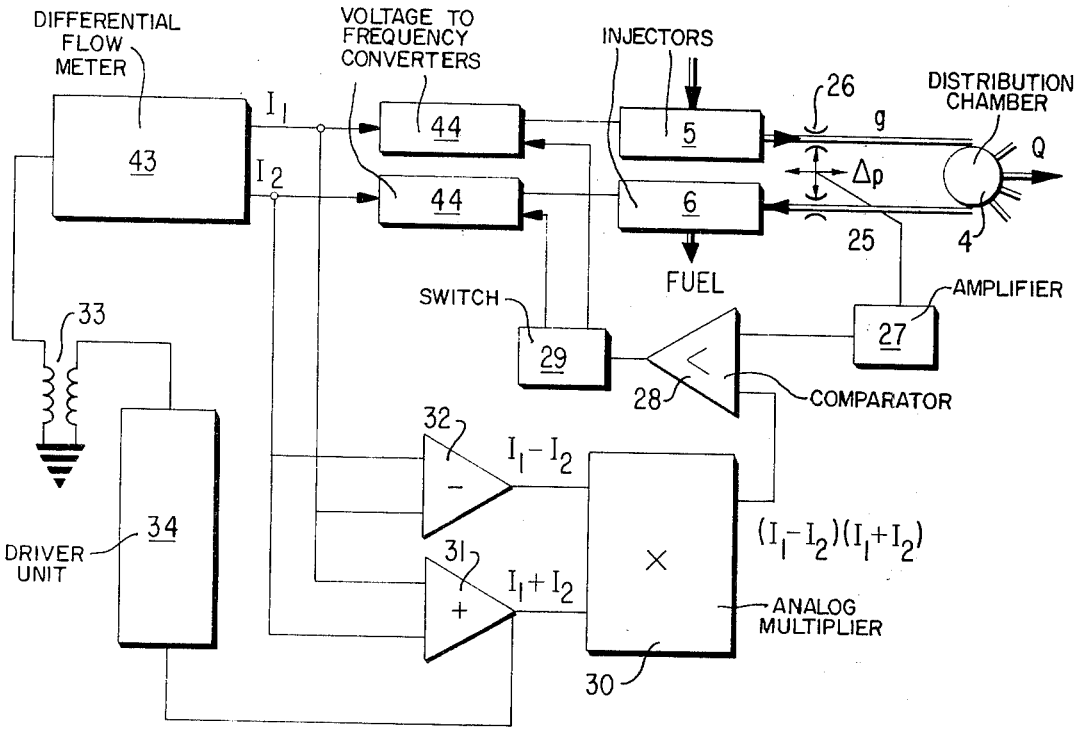
FIG. 4 is a schematic and partial block diagram of an electronic system according to the present invention for realizing the servo loop which connects the functioning errors of the injectors.

From this very simplified expression, the electronic servo loop can be realized according to the schematic of FIG. 4 and can be either a part of computer 7, or made independently. This loop has a differential flow meter 43 for measuring the mass flow $D_m$ of the intake air, the functional characteristic of which is:

$$D_m = \frac{K(I_1 - I_2)U}{I_1 + I_2}$$

where $I_1$ and $I_2$ are the output currents of the sensor of the differential flow meter, U is the sensor supply voltage, and K is a proportionality constant. The differential flow meter 43 used in the system of the present invention may be a conventional device of the type disclosed in U.S. Pat. No. 3,732,854, or in U.S. Pat. No. 3,470,741.

The flowmeter 43 has its outputs connected to two voltage/frequency converters 44 of a known type, which may be, for example, like the model described in the French pat. application No. 72/16,823 in the same names as the assignee of the present application, corresponding to U.S. application 358,963 filed May 10, 1973. The converters 44 drive the injectors 5 and 6 with a controllable continuous flow while feeding the distribution chamber 4 which feeds the injectors 1, according to FIG. 1. The differential pressure sensor 9 is connected between the two identical orifices 25 and 26 of the continuous injectors 5 and 6. Sensor 9 measures the differential pressure $\Delta p$.

An amplifier 27 is associated with sensor 9 and drives a comparator 28 which compares the value of the differential pressure $\Delta p$ with an electrical value related to the value of the mass flow of air $D_m$. To the output of comparator 28 is connected a switch 29 for correcting the excitation frequency of one or the other of the injectors 5 and 6 according to the sign of the output of comparator 28.

An analog multiplier 30 transmits its output $(I_1 - I_2)(I_1 + I_2)$ to the input of the comparator 28. The factors $(I_1 + I_2)$ and $(I_1 - I_2)$ are respectively supplied to multiplier 30 by an analog summing device 31 and an analog subtractor 32, which are connected to the outputs of differential flowmeter 43 which provides the value of the mass flow of air $D_m$.

A pulse transformer 33 furnishes the voltage U to differential flowmeter 43 and is itself driven by a driver unit 34 which receives the current $(I_1 + I_2)$ from the output of the summing device 31. Driver unit 34 has a current pulse amplifier that is triggered by a signal from outside the system and is controlled by the value $(I_1 + I_2)$ in such a manner that the voltage U remains exactly proportional to $(I_1 + I_2)$. Accordingly, if $$\frac{U}{I_1 + I_2} = K = \text{a constant},$$

then $$D_m = K'(I_1 - I_2), \text{ wherein } K' \text{ is a constant.}$$

Using the same notation described hereinabove:

$$\frac{I_1 - I_2}{I_1 + I_2} = \frac{D_m}{KU} \quad (1) \text{ and}$$

$$\frac{V_1 - V_2}{V_1 + V_2} = \frac{Q}{SV} \quad (2)$$

If we set: $V_1 = K''I_1$ and $V_2 = K''I_2$, equation (2) becomes:

$$\frac{I_1 - I_2}{I_1 + I_2} = \frac{Q}{SV} = \frac{D_m}{KU} \quad \text{or}$$

$$R = \frac{D_m}{Q} = \frac{KU}{SV} = \frac{kU}{V} = \text{the richness of the mixture}$$

wherein U is of the form $a(I_1 + I_2)$ and V is of the form $b(V_1 + V_2) = c(I_1 + I_2)$ and $a$, $b$ and $c$ are constant coefficients.

The result is that if the comparator 28 compares $(I_1 - I_2)(I_1 + I_2)$ calculated by the multiplier 30 with $$\frac{2\Delta p}{m} = K''^2(I_1 - I_2)(I_1 + I_2)$$

measured by the differential pressure sensor 9, a resultant richness R which remains constant can be obtained.

Generally speaking, such a servo loop assures proportionality between two different physical quantities (in the case of the example cited, between a mass flow of fuel and a mass flow of air) by the symmetry of the connection and of the functioning between a differential measurer (like the differential sensor 9) and a differential actuator (like the differential injectors 5 and 6). The result is a constant ratio between the two input and output quantities which are functions of time. As is the case in the cited example, such a servo loop guarantees precise functioning of any arrangement relating two physical quantities in a constant ratio by compensating for all the inaccuracies and flows in the construction of the system which connects them, which can thereby be realized very economically.

Figure 5:
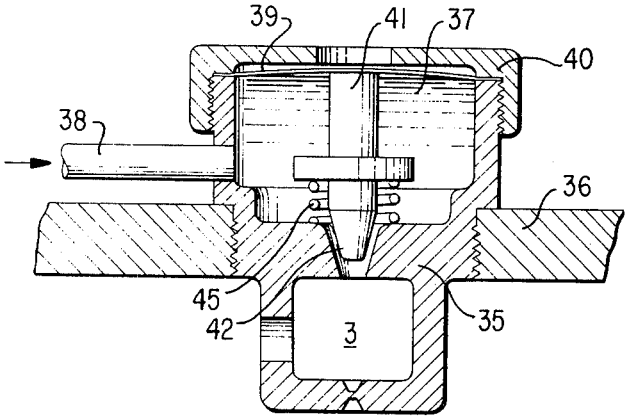
FIG. 5 is a cross-sectional view of an embodiment of an injector at a cylinder which has improved flow dynamics.

The precision flow of injectors 1 with a preset opening pressure can also be improved by the alternative preferred embodiment depicted in FIG. 5. The injector therein consists of a body 35 screwed into the wall of the intake duct 36, within which is located a stabilizing isobaric chamber 3, as disclosed in the French pat. application No. 72/44,846 hereinabove cited. Chamber 3 communicates with the pressure chamber 37 of the injector by means of an orifice with a conical seat 42 adjustably closed by a needle 41. The pressure chamber 37, fed by fuel line 38 from distribution chamber 4, is closed above by a membrane 39 maintained and sealed by a perforated cap 40. The injection needle 41 is attached to membrane 39 at its center. Deformation of the membrane 39 by injection pressure causes the needle 41 to lift off its conical seat 42 and thereby causes a given quantity of fuel to be injected first into chamber 3 and then into the intake duct on a level with the valves. Below the preset pressure of the injector, membrane 39 will hold the needle 41 shut on its seat 42.

In a preferred embodiment, the stem of needle 41 has a shoulder contacting a spring 45 pressing against the bottom of chamber 37, the effect of which is to maintain the needle 41 in contact with membrane 39. This arrangement simplifies the construction and assembly of the parts. The spring 45 permits easy adjustment and calibration of the deformation of membrane 39 and the sensitivity of the lift of needle 41. The injector configuration of FIG. 5 has the advantage of an improved output dynamic range for a given dynamic range of pressure. In preset pressure injectors of known types, the flow Q is provided by an injection orifice of cross-sectional area S, such that:

$$Q = S\sqrt{\frac{2\Delta p}{m}} = SV$$

wherein m is the volumetric mass of fuel and V is the flow velocity. The result is that, since the dynamic range of the output flow is proportional to the square root of that of the pressure, a dynamic flow range of 1 to 30 generally required in such applications will be produced by a pressure dynamic range on the order of 1 to 900. The velocity law $$V = 2\sqrt{\frac{\Delta p}{m}},$$

however, is an unchangeable law of physics. There results a lack of precision and sensitivity of the injectors. To remedy this defect, the injector conforming to the present invention realizes a linear variation of orifice area with pressure. The deformation of membrane 9 is proportional to $\Delta p$ so that the lift of needle 41 equals $K\,\Delta p$ and the area of the opening is $S = K\,\Delta p$. The resulting flow Q is of the form:

$$Q = S\sqrt{\frac{\Delta p}{m}} = K\,(\Delta p)^{3/2}.$$

Thus, with such a configuration, a dynamic flow range on the order of 1 to 30 is produced by a dynamic pressure range on the order of 1 to 10, thereby providing increased sensitivity and precision of injection for an injector 1 which therefore may be of simple and economical construction.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by letters patent of the United States is:

1. A system for electronic fuel injection for use in internal combustion engines, comprising:

a plurality of cylinder injectors positioned at the cylinders of the engine, a distribution chamber for feeding fuel to said cylinder injectors and for receiving fuel from said cylinder injectors, a fuel reservoir, an inlet control injector for receiving fuel from said fuel reservoir and for directing it to said distribution chamber, means for supplying pressurized fuel to said inlet control injector, an outlet control injector for receiving fuel from said distribution chamber and for returning it to said fuel reservoir, a pressure differential sensor for sensing the pressure difference between the outlet of said inlet control injector and the inlet of said outlet control injector, means responsive to said pressure differential sensor for controlling the operation of said inlet control injector and for controlling the operation of said outlet control injector.

2. The system for fuel supply according to claim 1, wherein said inlet and outlet injectors comprise continuous flow electromagnetic injectors and are controlled by a variable frequency signal from an electronic computer.

3. The system according to claim 2, wherein the control of said flow through said injectors is effected in a band of frequencies wherein the flow variation is a linear function of the said frequency.

4. The system according to claim 3, wherein the change in said flow is proportional to the lift of a needle slidably positioned inside a solenoid coil, the said lift being produced against the balancing force of a spring.

5. The system according to claim 1, wherein variations in the characteristics of the net flow of said inlet and outlet injectors are connected by means of a servo loop causing a correlative connection of command signals from an electronic computer to said injectors.

6. The system according to claim 5, wherein said servo loop is commanded by a differential pressure sensor connected between the output of said inlet injector and the input of said outlet injector.

7. The system according to claim 5, wherein the cross-sections of the fuel lines at the measuring points of said differential sensor are identical.

8. The system according to claim 1, wherein said differential injectors are commanded by a differential flowmeter which measures a mass flow ($D_m$) of fluid, the ouput currents ($I_1$, $I_2$) of which drive, by means of two voltagefrequency converters, said continuous flow differential injectors.

9. The system according to claim 8, wherein said voltage-frequency converters which command said injectors are controlled by a switch for correcting the excitation frequency of said injectors and which is commanded by a comparator for comparing the values of the differential pressure ($\Delta$ p) given by said differential sensor and of the mass flow of fluid (Dm) given by said differential flowmeter.

10. The system according to claim 8, wherein said differential flowmeter has an operating characteristic in the form:

$$D_m = \frac{K\,(I_1 - I_2)}{I_1 + I_2}\,U$$

where $I_1$ and $I_2$ are said output currents of said flowmeter sensor, U is the supply voltage and K is a proportionality constant.

11. The system according to claim 9, wherein said comparator receives the value (Dm) of the mass flow of fluid by way of an analog multiplier in the form $(I_1 + I_2)\,(I_1 - I_2)$, the factors being supplied to said multiplier by an analog summer and an analog subtractor which are connected to the output of said differential flowmeter which provides the values $I_1$ and $I_2$.

12. The system according to claim 11, wherein said differential flowmeter receives its supply voltage from a pulse transformer that is driven by a driver containing a current pulse amplifier with triggering by an external signal, and which is controlled by the value $(I_1 + I_2)$ from the output of said summer.

13. The system according to claim 1, wherein said injectors having a preset opening pressure have a characteristic of flow Q as a function of the variation $\Delta p$ of fluid pressure of the form:

$Q = K (\Delta p)^{3/2}$, K being a constant.

14. The system according to claim 1, wherein said injectors having a preset opening pressure include a chamber fed by pressurized fluid and closed by an obturating member for opening an injection orifice against elastic means acting in the direction of its closure under the action of a fluid pressure exceeding said preset opening pressure, wherein said elastic means comprises a membrane which deforms under the action of the pressure and which causes by its deformation the opening of said member.

* * * * *